United States Patent [19]

Chang et al.

[11] 4,367,873

[45] Jan. 11, 1983

[54] GAME BALL

[76] Inventors: Paul P. H. Chang, Room 3, 7 Fl. No. 603, Tung-Hwa S. Rd., Taipei; Chen-Shin Chu, No. 17, La. 685, Chung-Hsing Rd., Lung-Tan, Taoyuan, both of Taiwan

[21] Appl. No.: 279,020

[22] Filed: Jun. 30, 1981

[51] Int. Cl.[3] ..... A63B 37/12; A63B 37/06

[52] U.S. Cl. ..... 273/60 R; 273/DIG. 4; 273/DIG. 5

[58] Field of Search ..... 273/60 R, 60 A, 60 B, 273/DIG. 4, 235 R, 230, 218, 217

[56] References Cited

U.S. PATENT DOCUMENTS

| | | | |
|---|---|---|---|
| 1,558,706 | 10/1925 | Mitzel | 273/217 |
| 2,787,024 | 4/1957 | Smith | 273/235 R X |
| 2,938,237 | 5/1960 | Kern et al. | 273/60 B |
| 3,908,993 | 9/1975 | Gentiluomo | 273/230 X |
| 3,940,145 | 2/1976 | Gentiluomo | 273/218 |
| 3,976,295 | 8/1976 | Heald | 273/60 R |
| 4,149,720 | 4/1979 | Heald | 273/60 R |
| 4,211,407 | 7/1980 | Tomar | 273/60 B |

FOREIGN PATENT DOCUMENTS

| | | | |
|---|---|---|---|
| 649217 | 1/1951 | United Kingdom | 273/218 |

*Primary Examiner*—George J. Marlo

*Attorney, Agent, or Firm*—Cushman, Darby & Cushman

[57] ABSTRACT

A game ball for use in playing such games as baseball or softball comprises a spherical core made of PVC foam, a core cover of an ethylene copolymer, the core cover having a corrugated or rough surface, yarn windings and an outer leather cover, the ball having lower production cost and good durability in addition to essentially the same playing characteristics as conventional balls.

5 Claims, 2 Drawing Figures

GAME BALL

BACKGROUND OF THE INVENTION

One prior art game ball comprises a spherical core member formed of flexible and resilient molded polyurethane foam and a cover portion comprising a leather member stitched over and enclosing the core member. The leather cover may be stitched over the core of polyurethane foam by embedding yarn windings or adhesive between the core and the cover. Since the outer surface of the urethane core is not corrugated, after repeated pitching and catching actions as a result of playing games, the core may loosen from the cover. In such a manner, the pitching moment or accuracy of the ball will be seriously affected.

Another prior art game ball discloses a composite ball having a spherical core and a cover, wherein said core is formed from isocyanate and a mixture of catalyst and blowing agent. However, such an isocyanate material will increase the production cost of ball as compared to conventional balls, such as balls made of cork and rubber core, or PVC foamed balls.

Another prior art baseball includes an improvement wherein the core consists essentially of a single spherical mass of blown ethylene vinyl acetate copolymer thermoplastic resin having 12% to 30% by weight polymerized vinyl acetate units. Such a ball, however, is still more expensive than conventional baseballs.

Another prior art publication discloses a centerless thick-walled game ball comprising a hollow spherical mass, a cork-rubber capsule, thread windings and a cover exhibits a greater moment of inertia compared to filled balls so as to improve aerodynamic characteristics of the ball. Since such a ball should be made of equal weight and size as a conventional ball, the density of the cork-rubber capsule must be increased to compensate the hollow core whereby a heavier filler should be incorporated into the rubber capsule composite which will be easily broken in use. Thus, a special high-density rubber should be provided which necessarily increases the cost of ball production.

The conventional arts do not disclose the corrugate or rough surface on the core cover to increase the binding friction between the core and the outermost cover so that, according to conventional balls, the outermost cover thereof may be loosened from the core after being used over a period of time.

The present inventors have found these defects of conventional balls. The improvements over the prior balls have been made by the present inventors in view of the following specification and the accompanying drawings.

SUMMARY OF THE INVENTION

One object of the present invention is to provide a game ball comprising a spherical core made of polyvinyl chloride (PVC) foam, a core cover made of ethylene copolymer, yarn windings and an outermost leather cover so as to increase the moment of inertia for improving aerodynamic characteristics and to reduce the production cost thereof.

Another object of the present invention is to provide a ball comprising a spherical core coated with a core cover having a corrugate or rough surface to have a buffering effect on impacted during playing and to increase the friction and binding strength between the core, the core cover and the outermost cover.

DESCRIPTION OF THE PREFERRED EMBODIMENT

Figure 1:
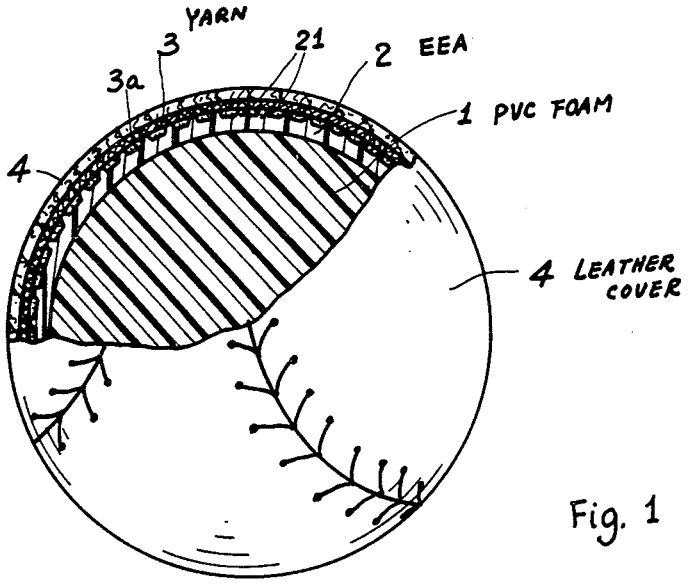
FIG. 1 is a partial cut-away illustration of the present invention.

As shown in the accompanying figures, the game ball of the present invention comprises a spherical core 1, a core cover 2, yarn windings 3 and an outer leather cover 4.

Spherical core 1 is made of polyvinyl chloride (PVC) foam with the following composition (parts by weight):

1. PVC Resin—100 parts
2. Plasticizer—50–120 parts
3. Foaming agent—0.5–5 parts
4. Stabilizer—0.5–5 parts Cover 2 is made of ethylene copolymer, such as, a copolymer of ethylene or the like (EEA) or with methyl acrylate. The ethyl acrylate content is about 15% by weight based on the copolymer. The thickness of cover 2 ranges from about one eighth of an inch to half an inch and is preferably half an inch. The ethylene copolymer offers good resilience for the ball and nice compatibility as well as strong adhesion with the PVC foam of core 1.

Figure 2:
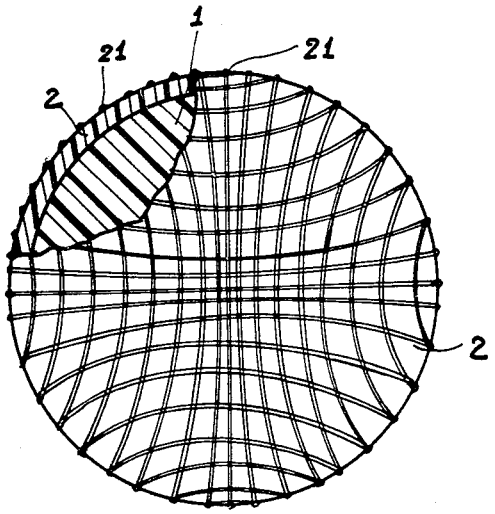
FIG. 2 is an outer illustration of said core having corrugate or rough cover in accordance with the present invention.

Cover 2 is formed with corrugations or rough patterns on its outer surface as shown in FIG. 2. The extension height of corrugations or rough patterns 21 ranges from one sixteenth to one eighth of an inch and is preferably one sixteenth of an inch. The extension width of the corrugations and rough pattern may also be same as the height thereof.

The density of the PVC foam core 1 is less than that of the core cover 2 so as to exhibit a moment of inertia greater than the moment of inertia of a filled conventional ball of equivalent size and weight thereby improving aerodynamic characteristics.

Yarn windings 3 may be wound over cover 2 and core 1 after coating cover 2 onto core 1. Glue or adhesive 3*a* is dipped into yarn windings 3 to bind the outer leather cover 4 with core cover 2 and core 1. The outermost leather cover 4 is stitched over the core in the same manner as conventional balls. The outermost leather cover 4 may be made of natural leather or synthetic or artificial leather.

The present invention is superior to any conventional baseball or softball and has following advantages:

1. PVC foam core 1 bound with a core cover, having greater density, may increase the moment of inertia for improving aerodynamic characteristics and may greatly reduce the cost of the ball as compared to a conventional ball which is fully filled with polyurethane foam or copolymer of ethylene vinyl acetate.
2. The corrugations or rough patterns 21 of core cover 2 may furnish a buffering effect when impacted in playing games so as to prolong the service life of the ball and to enhance the resilient property for playing ball. Also, the corrugations or rough patterns 21 may increase the binding friction and strength between the outer cover 4 and the inner core 1.

When the ball of the present invention is utilized for training or informal playing purposes, the layer of core cover 2 may be omitted to further save on production costs. The core 1 made of PVC foam may have rough surface 21 directly formed thereon to bind with outer cover 4. However, for longer and qualified uses, the single PVC foam core 1 is not satisfactory as PVC foam may be cured or aged after long playing time.

PVC foam core 1 may be directly bound with an outer cover 2 made of ethylene copolymer as aforementioned in order to further simplify the production of the ball according to the present invention.

The present invention should be made in size, weight and all other properties to be in conformance with regulations or specifications of organized game ball leagues.

We claim:

1. A game ball for use in playing such games as baseball or softball comprising a spherical core, a core cover, yarn windings and an outer leather cover to have essentially the same playing characteristics as conventional balls, the improvements which comprise:

(a) a spherical core made of polyvinyl chloride foam coated with a core cover made of ethylene copolymer; and (b) corrugations and rough patterns being formed on the outer surface of said core cover.

2. A game ball according to claim 1 wherein said ethylene copolymer is a copolymer of ethylene with ethyl acrylate.

3. A game ball according to claim 1 wherein said core cover has a thickness ranging from about one eighth inches to half an inch and preferably being half an inch.

4. A game ball according to claim 1 wherein the extension height or width of said corrugations or rough patterns of said core ranges from about one sixteenth of an inch to one eighth of an inch.

5. A game ball according to claim 1 wherein the extension height or width of said corrugations or rough patterns of said core cover is about one sixteenth of an inch.

* * * * *